US006361738B1

(12) United States Patent
Kaneko et al.

(10) Patent No.: US 6,361,738 B1
(45) Date of Patent: Mar. 26, 2002

(54) METHOD OF PRODUCING R-FE-B PERMANENT MAGNET, AND LUBRICANT AGENT AND RELEASE AGENT FOR USE IN SHAPING THE SAME

(75) Inventors: Yuji Kaneko, Uji; Junichiro Baba, Osaka; Kazuo Tanaka; Shizuo Mori, both of Yokohama, all of (JP)

(73) Assignee: Sumitomo Special Metals Co., Ltd., Osaka (JP)

( * ) Notice: Subject to any disclaimer, the term of this patent is extended or adjusted under 35 U.S.C. 154(b) by 0 days.

(21) Appl. No.: 09/446,334

(22) PCT Filed: Apr. 22, 1999

(86) PCT No.: PCT/JP99/02151

§ 371 Date: Mar. 28, 2000

§ 102(e) Date: Mar. 28, 2000

(87) PCT Pub. No.: WO99/54892

PCT Pub. Date: Oct. 28, 1999

(30) Foreign Application Priority Data

Apr. 22, 1998 (JP) ..... 10-129506
Oct. 6, 1998 (JP) ..... 10-283908
Apr. 21, 1999 (JP) ..... 11-113800

(51) Int. Cl.[7] ..... B22F 3/12

(52) U.S. Cl. ..... 419/36; 419/38; 75/231; 252/62.53; 148/103; 148/302; 524/404

(58) Field of Search ..... 419/36, 37, 38; 75/231; 252/62.53; 148/103, 302; 524/404

(56) References Cited

U.S. PATENT DOCUMENTS 5,051,200 A * 9/1991 Srail et al. ..... 252/62.54
5,990,218 A * 11/1999 Hill et al. ..... 524/431

* cited by examiner

*Primary Examiner*—Ngoclan Mai
(74) *Attorney, Agent, or Firm*—Dykema Gossett PLLC

(57) ABSTRACT

The method of producing an R—Fe—B magnet of the present invention is characterized in that R—Fe—B alloy fine powder is molded in a magnetic field and sintered using a lubricant for molding magnets containing specific components, individually or as a mixture, of specific amounts of methyl caproate and/or methyl caprylate, which provide high crystal orientation, and lubricant comprising depolymerized polymer for improving molded article strength, or a lubricant for molding magnets wherein Ti coupling agent that improves crystal orientation is added to this lubricant for molding magnets. Each particle of the fine powder has a high degree of crystal orientation in the direction of the magnetic field, and molded article strength is markedly improved, leading to improved mass-productivity and yield. Moreover, the above-mentioned lubricants do not react with this magnet powder during sintering and are emitted as a gas. Therefore, binder removal performance is excellent and as a result, an increase in the amount of C remaining in the sintered compact is inhibited, to obtain an R—Fe—B permanent magnet with high Br and iHc properties.

24 Claims, No Drawings

METHOD OF PRODUCING R-FE-B PERMANENT MAGNET, AND LUBRICANT AGENT AND RELEASE AGENT FOR USE IN SHAPING THE SAME

TECHNICAL FIELD

The present invention pertains to a method of producing an R—FE—B permanent magnet with which high crystal orientation is obtained and molded article strength is high and therefore, productivity is excellent. It relates to a method of producing an R—Fe—B magnet, wherein high crystal orientation is obtained, molded article strength is markedly improved, and an R—Fe—B magnet with a high Br can be mass-produced at a good yield by adding and mixing a lubricant for molding magnets, characterized in that specific amounts of methyl caproate and/or methyl caprylate, with which high crystal orientation can be obtained, and a lubricant comprising a depolymerized polymer for improving molded article strength are added, individually or as a combination, to R—Fe—B alloy fine powder, or by adding and mixing a lubricant for molding magnets, characterized in that a Ti coupling agent for improving crystal orientation is further combined with these lubricants for molding magnets, and then molding in a magnetic field.

BACKGROUND ART

In general, R—Fe—B (R is one or more rare earth element, including Y, and some of the Fe can be substituted with Co) permanent magnet starting powders are usually made by the following process 1) through 2) or 1a) through 2b):

1) A rare earth metal, electrolytic iron, and ferroboron alloy or, further, electrolytic Co, are melted under high-frequency as the starting material and cast into a mold or cast onto a quenching roll (strip casting method) to make ingots.

2)After crushing the ingots by the $H_2$ occlusion and comminution method, 1.5 to 5.0 $\mu$m fine powder starting material is obtained by wet comminution with a ball mill attritor, or by jet mill comminution using inert gas.

1a) Metallic Ca and $CaCl_2$ are mixed with a mixed powder of at least one type of rare earth oxide, iron powder and at least one of pure boron powder, ferroboron powder, and a boron oxide, or an alloy powder or a mixed oxide of the above-mentioned structural elements that have been combined to a specific composition and then reduced and diffused in an inert gas ambient atmosphere. The reaction product that is obtained is sprayed and treated with water (reduction-diffusion method).

2b) The above-mentioned treated product is made into a 1.5 to 5.0 $\mu$m fine stating powder by wet comminution with a ball mill attritor or by dry comminution with a jet mil.

As previously mentioned, pulverization of the starting powder for R—Fe—B permanent magnets is performed by wet comminution or dry comminution. However, there are problems with wet comminution in that the fine powder that is obtained contains C or $O_2$ from the organic solvent, impurities from abrasion of the balls are mixed in the fine powder, etc., and therefore, pulverization of starting powder for rare earth magnets is being changed to dry comminution.

However, $N_2$ gas or Ar gas with a purity of 95% or higher is being used as the gas that generates the jet mill for pulverization by a jet mill, which is dry comminution, in order to prevent oxidation, as well as to prevent ignition and combustion, of the fine powder, and there are problems in that when compared to wet comminution methods, such as attritor pulverization methods, etc., comminution efficiency is poor, and moldability is also poor because of the powder that is obtained.

In order to solve the problems with conventional dry comminution methods, methods are being tested whereby after adding and mixing stearic acid solid lubricant, such as zinc stearate, calcium stearate, etc., with a crushed powder before jet mill comminution, jet mill comminution is performed, or the above-mentioned stearic acid solid lubricant is added and mixed with fine powder after jet mill comminution, and then molding is performed.

However, it is extremely difficult to uniformly mix the above-mentioned solid lubricant with fine powder of a starting alloy for R—Fe—B permanent magnets, and there are fluctuations per unit weight during press molding, leading to defects such as cracking, etc.

Therefore, a method of producing an R—Fe—B magnet was previously presented by the present inventors (Japanese Patent Publication Laid-Open No. 8-111308) wherein after at least one fatty acid ester lubricant (lauric acid ester lubricant, oleic acid ester lubricant) is added and mixed with starting crushed powder of a specific composition, the powder is pulverized and the fine powder that is obtained is molded and sintered and aged as a method of producing an R—Fe—B magnet of markedly improved comminution efficiency during jet mill comminution as well as excellent press filling performance and excellent orientation performance. However, there are problems with methods that use the above-mentioned lubricants in that it is difficult to remove the binder and molded article strength is poor, leading to poor production yield.

Moreover, it is suggested that, in order to improve moldability, a binder with excellent binding force, such as PVA (polyvinyl alcohol), etc., be added during granulation of the magnet powder, but there are problems with removal of the binder during sintering, and there are problems in that special treatment, such as sintering in an $H_2$ reducing ambient atmosphere, etc., becomes necessary, there is a reduction in magnet properties with an increase in the amount of C remaining in the sintered compact, etc.

SUMMARY OF THE INVENTION

The present invention is based on problem points of lubricants that are added and mixed with R—Fe—B alloy powder that has been obtained by comminution of an alloy produced by the above-mentioned melting and casting method, strip casting, etc., or powders of an R—Fe—B permanent magnet composition obtained by Ca reduction, its purpose being to present a method of producing R—Fe—B permanent magnets and a lubricant for molding the same magnet with which binder removal is improved, high crystal orientation and an excellent Br are obtained during molding in a magnetic field, and molded article strength is high, making mass-productivity excellent and improvement of yield possible.

The inventors performed various studies of effective lubricants when mixed with starting fine powder for R—Fe—B magnets obtained by any of a variety of conventional methods in order to improve binder removal, improve orientation performance during molding in a magnetic field, improve molded article strength, and improve mass-productivity and yield of methods of producing R—Fe—B permanent magnets and as a result, they discovered lubricants with specific components that are at least one of methyl caproate lubricant or methyl caprylate lubricant, or a combination with Ti coupling agent further added and mixed.

Moreover, the inventors similarly discovered a lubricant comprising depolymerized polymer, as well as a lubricants wherein hydrocarbon solvent with a boiling point of 80 to 250° C. is combined with this lubricant, or said solvent and low-viscosity mineral oil with a boiling point of 200 to 500° C. and dynamic viscosity (40° C.) of 3 to 30 $mm^2$/second is mixed with this lubricant.

Furthermore, the inventors discovered that when a combination lubricant for molding magnets consisting of a specific amount of at least one of methyl caproate and methyl caprylate and a lubricant comprising depolymerized polymer is used, each of the above-mentioned lubricants can be uniformly coated on the surface of the fine powder and when this kneaded product is molded in a magnetic field, each particle of the fine powder has high crystal orientation in the direction of the magnetic field, and molded article strength is markedly improved, leading to improved mass-productivity and yield. Moreover, the above-mentioned lubricant is released as a gas without reacting with this magnet powder during sintering and therefore, there is excellent removal of the binder. As a result, an R—Fe—B permanent magnet with high Br and iHc properties is obtained while controlling an increase in the amount of C remaining in the sintered compact.

Moreover, the inventors discovered that when a specific amount of Ti coupling agent is mixed in the lubricant for molding a magnet consisting of at least one of methyl caproate and methyl caprylate and depolymerized polymer as the remainder, improved molded article density and improved crystal orientation are obtained.

Furthermore, the inventors discovered that the 3 lubricants of (1) lubricant consisting of depolymerized polymer only, (2) lubricant consisting of 0.1 wt % to 99.9 wt % depolymerized polymer and hydrocarbon solvent with a boiling point of 80° C. to 250° C. as the remainder, and (3) lubricant consisting of 0.1 wt % to 70.0 wt % depolymerized polymer, 5.0 wt % to 70.0 wt % low-viscosity mineral oil with dynamic viscosity (40° C.) of 3 to 30 $mm^2$/second, and hydrocarbon solvent with a boiling point of 80 to 250° C. as the remainder are optimum lubricants comprising the above-mentioned depolymerized polymer for molding magnets and thereupon completed the present invention.

At the same time, the inventors performed studies of mold releases for R—Fe—B sintered magnets in order to reduce defects such as cracks, etc., particularly to reduce ejection pressure, reduce the amount of spring back, and improve green strength, when molded articles of a specific size are molded to produce R—Fe—B sintered magnets and they discovered that when a mold release consisting of a combination of specific amounts of a volatile methyl caproate or methyl caprylate, which prevent an increase in the amount of carbon contained in the sintered compact after sintering, as the main component and a saturated fatty acid with 20 to 24 carbons having excellent lubricating performance, with the remainder being volatile solvent, is used, it is possible to prevent an increase in ejection pressure with press pressurization, this difference being more marked with molded articles having a higher density, and the amount of 80spring back can be reduced by approximately 3% when compared to the case where molding is performed with a conventional mold release that uses methyl laurate.

BEST MODE FOR CARRYING OUT THE INVENTION

Methyl Caproate Lubricant, Methyl Caprylate Lubricant (Type 1)

The composition of the methyl caproate lubricant added and mixed with fine powder with an R—Fe—B magnet composition in this invention is 0.2 to 50 wt % methyl caproate and isoparaffin with a boiling point of 120 to 180° C. for the solvent as the remainder. Moreover, in addition to isoparaffin, 1 or two or more hydrocarbon solvents with a relatively low vapor pressure, such as normal paraffin, or toluene, xylene, etc., can also be mixed and used as the solvent.

Furthermore, the composition of the methyl caprylate lubricant is 0.2 to 50 wt % methyl caprylate and isoparaffin with a boiling point of 120 to 180° C. for the solvent as the remainder. In addition, the solvent can be a mixture of 1 or 2 or more of the above-mentioned hydrocarbon solvents in addition to the isoparaffin.

The amount of above-mentioned lubricant added in this invention is limited to 0.01 to 5.0 wt % because if it is less than 0.01 wt %, lubricating performance will be insufficient and orientation performance will change for the worse, while if it exceeds 5.0 wt %, molded article strength will change for the worse, both of which are undesirable. The farther preferred amount added is 0.02 to 1.0 wt %.

In addition, the Ti coupling agent that is added in addition to the above-mentioned lubricant has the effect of improving crystal orientation performance of the powder particles and improving density of the molded article. An example of its chemical formula is shown below. R and R' are the structural formulas of $CnH_{2n+1}$ or $CnH_{2n}$.

$$(R)_2CHOTi(O\overset{\overset{\displaystyle O}{\|}}{C}R')_3$$

The amount of Ti coupling agent that is added is limited to 0.01 to 0.5 wt % because if less than 0.01 wt % is added, there will be little improvement of moldability and there will be no effect in terms of orientation performance, while if the amount exceeds 0.5 wt %, it will be difficult to remove the binder and there will be defects in the molded article, both of which are undesirable. The further preferred amount added is 0.01 to 0.1 wt %.

Lubricant for Molding Comprising Depolymerized Polymer (Type 2)

The depolymerized polymer contained in the lubricant for molding R—Fe—B permanent magnets of this invention is a copolymer of isobutylene and normal butylene, an isobutylene polymer, an alkyl methacrylate polymer or copolymer, or an alkylene glycol polymer or copolymer, and it can also contain terpene or aliphatic resins, etc., in order to improve binding force.

The content of depolymerized polymer in the lubricant for molding R—Fe—B permanent magnets of the present invention is (1) 100 wt % in the case where only depolymerized polymer is used, (2) 0.1 wt % to 99.9 wt % when it is used with a solvent, and (3) 0.1 wt % to 70.0 wt % when it is used with a solvent and low-viscosity mineral oil.

If the content is less than 0.1 wt % in above-mentioned (1) through (3), molded article strength will be weak, which is undesirable. On the other hand, the amount of C remaining in the sintered compact after molding increases with an increase in content, but because the depolymerized polymer rarely reacts with R—Fe—B permanent magnet and is released as a gas, there is an advantage in that even if relatively large amounts are used, there will be little detrimental effect on magnet properties. However, taking into consideration the effect on magnet properties, a content of 70.0 wt % or less is particularly preferred.

In addition, in the case of (1) where depolymerized polymer is used alone, it is preferred that a polymer with a molecular weight of 450 or less (dynamic viscosity (40° C.) of 150 $mm^2$/second or less) be used, and if a polymer with molecular weight exceeding 450 (dynamic viscosity (40° C.) exceeding 150 $mm^2$/second) is used, it is preferred that it be used in combination with a solvent or with a solvent and a low-viscosity mineral oil as in (2) or (3).

Normal paraffin solvent (8 to 15 carbons), isoparaffin solvent (8 to 15 carbons), naphthene solvent (6 to 15 carbons), or olefin solvent (8 to 15 carbons) with a boiling point of 80° C. to 250° C., as well as mixtures of the above-mentioned solvents, can be used as the solvent of the lubricant for molding in this invention. Furthermore, the solvent will account for the remainder of the content of depolymerized polymer mentioned above or low-viscosity mineral oil discussed below.

Furthermore, if depolymerized polymer cannot be uniformly coated on the surface of lie magnetic powder due to the state of the alloy powder, etc., the effects of the depolymerized polymer as a binder can be realized in full by mixing low-viscosity mineral oil with the lubricant in this invention.

Pure mineral oils with a dynamic viscosity within a range of 3 to 30 $mm^2$/second at 40° C. are low-viscosity mineral oils, and paraffin or naphthene systems can be used in the present invention, but a mineral oil with as few double bonds as possible is preferred. If the mineral oil content is less than 5 wt %, no effect will be seen with addition, while if it exceeds 70 wt %, the amount of C remaining in the sintered compact will be high and this will have a detrimental effect on magnet properties. Therefore, the preferred content is 5 wt % to 70 wt %, and the further preferred content is 10 wt % to 50 wt %.

If the amount of above-mentioned lubricant added to the R—Fe—B magnet powder is less than 0.01 wt %, there will be a reduction in molded article strength and if it exceeds 10 wt %, there will be an increase in the amount remaining in the sintered compact for sintering and a reduction in magnet properties and therefore, it is preferred that the amount added be 0.01 wt % to 10 wt %, and 0.02 wt % to 1.0 wt % is further preferred.

Lubricant for Magnet Molding Consisting of Lubricant Comprising Methyl Caproate and/or Methyl Caprylate and Depolymerized Polymer as the Remainder (Type 3)

The at least one of methyl caproate and methyl caprylate added to the fine powder of the R—Fe—B magnet composition is added in order to improve crystal orientation in this invention. However, if less than 0.01 wt % is added, there will not be enough lubricant and orientation performance will change for the worse, while if more than 5.0 wt % is added, there will be a reduction in molded article strength. Therefore, a range of 0.01 to 5.0 wt % is preferred, and the further preferred amount added is 0.02 to 1.0 wt %.

Moreover, the Ti coupling agent that is added in addition to the above-mentioned lubricant has the effect of improving density of the molded article and an example of its chemical formula is as previously given.

If the amount of Ti coupling agent added is less than 0.01 wt %, there will be little improvement in moldability and there will be no effect in terms of orientation performance, while if it exceeds 0.5 wt %, binder removal performance will change for the worse and the molded article will have defects. Therefore, a range of 0.01 to 0.5 wt % is preferred, and the further preferred amount added is 0.01 to 0.1 wt %.

The depolymerized polymer contained in the lubricant for molding R—Fe—B permanent magnets in this invention is a copolymer of isobutylene and normal butylene, isobutylene polymer, alkyl methacrylate polymer or copolymer, or alkylene glycol polymer or copolymer, and it can also contain terpene, aliphatic resins, etc., to improve binding force.

As with type 2, the depolymerized polymer content of the lubricant for molding R—Fe—B permanent magnets of the present invention is 100 wt % in case (1) where only depolymerized polymer is used, 0.1 wt % to 99.9 wt % in case (2) where it is used with a solvent, and 0.1 wt % to 70.0 wt % in case (3) where it used with solvent and low-viscosity mineral oil.

Furthermore, if the depolymerized polymer cannot be coated uniformly on the surface of the magnetic powder due to the state of the alloy powder, etc., the effects of the depolymerized polymer as a binder can be realized in full by mix low-viscosity mineral oil in the lubricant of this invention.

The low-viscosity mineral oil in this invention is a pure mineral oil with a dynamic viscosity within a range of 3 to 30 $mm^2$/second at 40° C. Paraffin or naphthene system can be used, but a mineral oil with as few double bonds as possible is preferred. If the content is less than 5 wt %, there will be no effect from adding the mineral oil, while if it exceeds 70 wt %, the amount of C remaining in the sintered compact will be high and there will be detrimental effects on magnet properties. Therefore, the content is preferably 6 wt % to 70 wt %, and the further preferred content is 10 wt % to 50 wt %.

If the amount of above-mentioned lubricant for molding magnets added to the R—Fe—B magnet powder is less than 0.01 wt %, lubricating performance will be insufficient and orientation performance will change for the worse, while if it exceeds 10 wt %, there will be an increase in the amount remaining in the sintered compact for sintering and there will be a reduction in magnet properties. Therefore, the amount added is preferably 0.01 wt % to 10 wt %, and 0.02 wt % to 1.0 wt % is further preferred.

An average particle diameter of the R—Fe—B magnet powder obtained by conventional production methods under 1.5 $\mu$m is undesirable because the powder will be extremely active and there is a chance that it will ignite during press molding, etc., processes, and there will be deterioration of magnet properties. Moreover, a particle diameter exceeding 5 $\mu$m is undesirable because the crystal particle diameter of the permanent magnet obtained by sintering will be large and reversal of magnetization will occur, leading to a reduction in coercive force. Therefore, the average particle diameter is 1.5 to 5 $\mu$m. An average particle diameter of 2.5 to 4 $\mu$m is further preferred.

Mold Release for Molding R—Fe—B Magnets

The mold release of this invention can be uniformly applied to the mold surface due to the vehicle effect of the solvent by being spread on the inside of the mold. A uniform thin film is formed by evaporation of the vehicle, and by dissolving this thin film in methyl caproate or methyl caprylate,,which are enriched with saturated fatty acids with 20 to 24 carbons that are particularly excellent in terms of adsorptivity onto the mold and thereby have release performance, excellent release performance can be realized. Moreover, since there is almost no penetration of the starting powder, magnetic properties of the sintered compact can be realized in full.

The present invention contains 1 or 2 of methyl caproate and methyl caprylate as the mold release component of the mold release. However, if it contains less than 2 wt %, there will be a marked reduction in mold release properties, and if it exceeds 20 wt %, there will be a marked drop in molded article strength. Therefore, 2 to 20 wt % is preferred. Moreover, purity of each component is 90% or higher, preferably 98% or higher, and the amount of these components that is added is preferably 5 to 10 wt %.

One or 2 or more saturated fatty acids with 20 to 24 carbons is added as admixture in this invention, and arachidic acid with 20 carbons, behenic acid with 22 carbons, and lignoceric acid with 24 carbons are preferred. There is no difference in the effect if 15 wt % or less of the admixture contains saturated fatty acid or unsaturated fatty acid with 18 carbons or less, such as stearic acid, oleic acid, etc.

If the amount of admixture added is less than 0.005 wt %, there will be a reduction in mold release performance, and if it exceeds 0.5 wt %, there will be problems in terms of a reduction in molded article strength and magnet properties and a range of 0.005 to 0.5 wt % is good. The preferred amount added is 0.01 to 0.1 wt % admixture with a purity of 95% or higher.

Vehicles such as normal paraffin, isoparaffin, cycloparaffin and aromatics, etc., with a boiling point of 80 to 200° C. are solvents that are the remainder of the mold release of this invention, and vehicles consisting of normal paraffin and isoparaffin with a boiling point of 100 to 180° C. are preferred. The amount added is 79.5 to 97.995 wt %. R—Fe—B magnet alloy powder.

The preferred composition range of the R—Fe—B magnet alloy powder of the present invention is described below. Rare earth element R used in this magnet alloy powder is a rare earth element selected from both light earths and heavy earths, including yttrium (Y). Rare earths are best for R, and Nd and Pr are particularly preferred. One R is usually used, but for practical application, 2 or more compounds (misch metal, didymium, etc.) can be used for reasons of convenience of acquisition, etc. Furthermore, this R is not necessarily a pure rare earth element and can contain impurities that are unavoidable during production as long as it is within a range that can be industrially acquired.

R is an essential element of the alloy powder that is used to produce R—Fe—B permanent magnets and if there is less than 10 atomic %, high magnetic properties, particularly high coercive force, will not be obtained, while if it exceeds 30 atomic %, there will be a reduction in residual magnetic flux density (Br) and a permanent magnet with excellent properties will not be obtained. Therefore, R is preferably within a range of 10 atomic % to 30 atomic %.

B is an essential element of the alloy powder that makes the R—Fe—B permanent magnet. If there is less than 1 atomic %, high coercive force (iHc) will not be obtained, and if there is more than 28 atomic %, residual magnetic flux density (Br) will decrease and therefore, an excellent permanent magnet will not be obtained. Consequently, a range of 1 atomic % to 28 atomic % is preferred.

If there is less than 42 atomic % of Fe, which is an essential element, there will be a reduction in residual magnetic flux density (Br), while if it exceeds 89 atomic %, high coercive force will not be obtained and therefore, the Fe is limited to 42 atomic % to 89 atomic %. Moreover, the reason for substituting part of the Fe with Co is that the effect of improving temperature properties of the permanent magnet and the effect of improving corrosion resistance will be obtained. However, if Co exceeds 50% of the Fe, high coercive force will not be obtained and an excellent permanent magnet will not be obtained. Therefore, 50% of the Fe is the upper limit of the amount of Co.

A composition based on 12 atomic % to 16 atomic % R, 4 atomic % to 12 atomic % B, and 72 atomic % to 84 atomic % Fe is desirable for the R—Fe—B alloy powder of this invention in order to obtain an excellent permanent magnet with both high residual magnetic flux density and high coercive force. In addition to the R, B and Fe, the presence of impurities that are unavoidable during industrial production in the R—Fe—B alloy powder of the present invention is acceptable, but it is possible to improve productivity and reduce cost of the magnet alloy by substituting at least one of 4.0 atomic % or less of C, 3.5 atomic % or less of P, 2.5 atomic % or less of S, and 3.5 atomic % or less of Cu, for a total of 4.0 atomic % or less, for part of the B.

Furthermore, by adding at least one of 9.5 atomic % or less of Al, 4.5 atomic % or less of Ti, 9.5 atomic % or less of V, 8.5 atomic % or less of Cr, 8.0 atomic % or less of Mn, 5 atomic % or less of Bi, 12.6 atomic % or less of Nb, 10.5 atomic % or less of Ta, 9.5 atomic % or less of Mo, 9.5 atomic % or less of W, 2.5 atomic % or less of Sb, 7 atomic % or less of Ge, 3.5 atomic % or less of Sn, 5.5 atomic % or less of Zr, and 5.5 atomic % or less of Hf to the above-mentioned R, B, Fe alloy or R—Fe—B alloy containing Co, it is possible to obtain high coercive force of the permanent magnet alloy.

EMBODIMENTS

Embodiment 1

Electrolytic iron with a purity of 99.9%, ferroboron alloy containing 19.8 wt % B, and Nd and Dy with a purity of 99.7% or higher were used for the starting alloy. These were mixed and then melted under high frequency. They were then cast into a mold with a water-cooling casting mold to obtain ingots with a composition of 14.5 at% Nd-0.5 at % Dy-78.8 at % Fe-6.2 at % B.

Then the above-mentioned ingots were crushed with a stamp mill and further comminution treatment was performed by hydrogen occlusion, etc., to obtain a crushed powder with an average particle diameter of 40 $\mu$m. The crushed powder that was obtained was pulverized by a jet mill with inert gas ($N_2$ gas) under conditions of a gas pressure of 6 kg/mm$^2$ to obtain fine powder with an average particle diameter of 3 $\mu$m.

Methyl caproate lubricant (boiling point: 150° C., effective component: 10%, Paresu Kagaku Co., Ltd., Magurupu PS-A-21) and methyl caprylate lubricant (boiling point: 150° C., effective component: 10%, Paresu Kagaku Co., Ltd., Magurupu PS-A-14), or Ti coupling agent (boiling point: 200° C. or higher, effective component: 97.0% or more, Ajinomoto Co., Ltd., Purenakuto KR-TTS) were added and mixed as shown in Table 1 wit the R—Fe—B fine powder that was obtained.

Then the above-mentioned fine powder was introduced to a mold and oriented in a magnetic field of 10 kOe. It was molded under a pressure of 1.5 T/cm$^2$ perpendicular to the magnetic field to obtain a molded article with dimensions 20 mm×15 mm×10 mm. Strength of the molded article that was obtained is shown in Table 1 and molding efficiency is shown in Table 2. Furthermore, molded article strength was determined by rattler tests and the method of determining transverse rupture strength. Moreover, the number of articles with no cracks or chips that were obtained without adding mold release served as the molding efficiency.

The molded article that was obtained was sintered in an Ar ambient atmosphere for 4 hours at 1,060° C. and then further aging was performed in an Ar ambient atmosphere for 1 hour at 600° C. The magnetic properties of the sample piece that was obtained are shown in Table 2.

Comparison 1

After adding and mixing 0.2 to 4.0 wt % ester lubricant (boiling point: 87° C., effective component: 25 wt % methyl oleate ester, 75 wt % cyclohexane, Paresu Kagaku Co., Ltd., Magurupu PS-A-1) as shown in Table 1 with crushed powder that had been obtained with the same composition and under the same conditions as in the example, comminution was performed with a jet mill to obtain fine powder with an average particle diameter of 3 $\mu$m and then molding in a magnetic field, sintering and aging were performed under the same conditions as in Embodiment 1. The strength of the molded article that was obtained is shown in Table 1 and the test piece magnetic properties and molding efficiency are shown in Table 2.

TABLE 1

| | Amount of lubricant added (wt %) | | | Molded article density ($Mg/m^3$) | Molded article strength: Rattler value (%) | Molded article strength: Transverse rupture strength (MPa) |
|---|---|---|---|---|---|---|
| | Methyl caproate | Methyl caprylate | Ti coupling agent | | | |
| Present invention | 0.01 | | | 4.25 | −20 | 1.40 |
| | 0.02 | | | 4.30 | −22 | 1.33 |
| | 0.50 | | | 4.40 | −25 | 1.22 |
| | 1.00 | | | 4.50 | −31 | 1.14 |
| | 0.02 | 0.50 | | 4.42 | −28 | 1.16 |
| | 0.50 | 0.02 | | 4.42 | −26 | 1.23 |
| | 0.02 | | 0.10 | 4.38 | −22 | 1.33 |
| | 0.50 | | 0.02 | 4.44 | −26 | 1.25 |
| | 0.02 | 0.50 | 0.02 | 4.49 | −31 | 1.14 |
| | 0.50 | 0.02 | 0.10 | 4.52 | −28 | 1.19 |

| | Amount of lubricant added (wt %) | Molded article density ($Mg/m^3$) | Molded article strength: Rattler value (%) | Molded article strength: Transverse rupture strength (MPa) |
|---|---|---|---|---|
| | Aliphatic acid ester system | | | |
| Comparison | 0.20 | 4.35 | −34 | 1.12 |
| | 1.00 | 4.45 | −38 | 1.00 |
| | 2.00 | 4.50 | −40 | 0.94 |
| | 4.00 | 4.50 | −53 | 0.64 |

TABLE 2

| | Magnet properties: Br (T) | Magnet properties: $Hc_B$ (kAm-1) | Magnet properties: (BH)max (kJm-3) | Magnet properties: $Hc_J$ (kAm-1) | Molding efficiency Number of articles molded continuously (articles) |
|---|---|---|---|---|---|
| Present invention | 1.314 | 955.0 | 330.2 | 1200.2 | 100 |
| | 1.323 | 962.9 | 333.4 | 1193.7 | 500 |
| | 1.333 | 978.8 | 346.2 | 1185.7 | 1000 or more |
| | 1.340 | 994.8 | 350.2 | 1185.7 | 1000 or more |
| | 1.335 | 978.8 | 347.0 | 1177.8 | 1000 or more |
| | 1.335 | 978.8 | 347.0 | 1193.7 | 1000 or more |
| | 1.331 | 978.8 | 345.4 | 1185.7 | 1000 or more |
| | 1.335 | 986.8 | 348.5 | 1185.7 | 1000 or more |
| | 1.342 | 994.8 | 350.9 | 1169.8 | 1000 or more |

TABLE 2-continued

| | Magnet properties: Br (T) | Magnet properties: $Hc_B$ (kAm-1) | Magnet properties: (BH)max (kJm-3) | Magnet properties: $Hc_J$ (kAm-1) | Molding efficiency Number of articles molded continuously (articles) |
|---|---|---|---|---|---|
| | 1.340 | 994.8 | 350.2 | 1169.8 | 1000 or more |
| Comparison | 1.310 | 947.0 | 326.3 | 1209.6 | 20 |
| | 1.317 | 955.0 | 338.2 | 1193.7 | 100 |
| | 1.325 | 962.9 | 342.2 | 1193.7 | 1000 or more |
| | 1.327 | 955.0 | 340.6 | 1201.7 | 1000 or more |

Embodiment 2

Electrolytic iron with a purity of 99.9%, ferroboron alloy containing 19.89 wt % B, and Nd and Dy with a purity of 99.7% or higher were used as the staring materials. These were mixed and melted under high frequency and then cast into a mold with a water-cooling casting mold to obtain ingots with a composition of 13.4 at % Nd-2.6 at % Dy-77.8 at % Fe-6.2 at % B.

Then the above-mentioned ingots were crushed with a stamp mill and further disintegrated by hydrogen occlusion, etc., to obtain crushed powder with an average particle diameter of 40 $\mu$m. The crushed powder that was obtained was pulverized using a jet mill under conditions of a gas pressure of 6 $kg/mm^2$ employing $N_2$ gas as the inert gas to obtain fine powder with an average particle diameter of 3 $\mu$m.

A copolymer with a molecular weight of 550 of isobutylene and normal butylene as the depolymerized polymer, naphthene purified mineral oil with a dynamic viscosity of5 $mm^2$/second at 40° C. as the low-viscosity mineral oil, and a mixture of normal paraffin solvent (8 to 15 carbons), isopain solvent (8 to 15 carbons) and naphthene solvent (6 to 15 carbons) with a boiling point of 80° C. to 250° C. as the hydrocarbon solvent were added and mixed with the R—Fe—B fine powder that was obtained as shown in Tables 3 and 4.

The fine powder to which the above-mentioned lubricant had been added and mixed was introduced to a mold and oriented in a magnetic field of 10 kOe and molded under pressure of 1.5 T/cm$^2$ perpendicular to the magnetic field to obtain a molded article with dimensions 20 mm×15 mm×10 mm.

Strength of the molded article that was obtained is shown in Table 5. Molded article strength was determined by the rattler test and method of determining transverse rupture strength. Moreover, molded article density and the molding fraction defective are shown in Table 7 as an evaluation of moldability. The number of articles with no cracks or chips that were obtained by press molding without adding a mold release served as the molding fraction defective.

The molded articles that were obtained were metered in an Ar ambient atmosphere for 4 hours at 1,060° C. and further aged in an ambient atmosphere for 1 hour at 600° C., and density, the amount of C and magnetic properties of the sintered compact that was obtained are shown in Table 6.

Comparison 2

Ester lubricant (boiling point of 87° C., effective components: 60 wt % methyl oleate ester, 50 wt % cyclohexane, and aqueous 10% PVA solution) were added as shown in Tables 7 and 8 at 0.2 to 4.0 wt % to fine powder that had been obtained with the same composition and under the same conditions as in Embodiment 2. Strength of the molded article that was obtained is shown in Table 3. Moreover, molded article density and the molding fraction defective are shown in Table 9.

The molded article that was obtained was sintered in an Ar ambient atmosphere for 4 hours at 1,060° C. and then further aged for 1 hour at 600° C. in an Ar ambient atmosphere. Density, the amount of C and magnetic properties of the sintered compact that was obtained are shown in Table 6.

TABLE 3

| | | Depolymerized polymer | |
|---|---|---|---|
| | | Average molecular weight | Dynamic viscosity (mm$^2$/sec) |
| Embodiment | 1 | 350 | 30 |
| | 2 | 350 | 30 |
| | 3 | 350 | 30 |
| | 4 | 350 | 30 |
| | 5 | 350 | 30 |
| | 6 | 350 | 30 |
| | 7 | 350 | 30 |
| | 8 | 400 | 90 |
| | 9 | 450 | 130 |
| | 10 | 450 | 130 |
| | 11 | 700 | 3000 |
| | 12 | 700 | 3000 |
| | 13 | 700 | 3000 |
| | 14 | 700 | 3000 |
| | 15 | 700 | 3000 |
| | 16 | 550 | 700 |
| | 17 | 800 | 4000 |
| Comparison | 20 | 350 | 30 |
| | 21 | 1000 | 10000 |
| | 22 | 1000 | 10000 |
| | 23 | 1500 | 40000 |
| | 24 | — | — |
| | 25 | — | — |
| | 26 | — | — |
| | 27 | — | — |

TABLE 3-continued

| | | Depolymerized polymer | |
|---|---|---|---|
| | | Average molecular weight | Dynamic viscosity (mm$^2$/sec) |
| | 28 | — | — |
| | 29 | — | — |
| | 30 | — | — |

TABLE 4

| | | Lubricant components (wt %) | | | Amount of |
|---|---|---|---|---|---|
| | | Depolymerized polymer | Low-viscosity mineral oil | Hydro-carbon solvent | lubricant added (wt %) |
| Embodiment | 1 | 100 | 0 | 0 | 3.0 |
| | 2 | 50 | 0 | 50 | 0.05 |
| | 3 | 50 | 0 | 50 | 3.0 |
| | 4 | 50 | 0 | 50 | 10.0 |
| | 5 | 70 | 0 | 30 | 3.0 |
| | 6 | 2 | 0 | 98 | 3.0 |
| | 7 | 100 | 0 | 0 | 10.0 |
| | 8 | 100 | 0 | 0 | 0.2 |
| | 9 | 100 | 0 | 0 | 0.1 |
| | 10 | 100 | 0 | 0 | 6.0 |
| | 11 | 70 | 20 | 10 | 0.5 |
| | 12 | 70 | 20 | 10 | 3.0 |
| | 13 | 30 | 30 | 40 | 2.0 |
| | 14 | 10 | 50 | 40 | 0.2 |
| | 15 | 10 | 50 | 40 | 5.0 |
| | 16 | 10 | 50 | 40 | 1.0 |
| | 17 | 20 | 70 | 10 | 2.0 |
| | | Oleic acid ester lubricant | PVA (Polyvinyl alcohol) | | |
| Comparison | 20 | 50 | 0 | 50 | 12.0 |
| | 21 | 100 | — | 0 | 0.5 |
| | 22 | 100 | — | 0 | 5.0 |
| | 23 | 100 | — | 0 | 1.0 |
| | 24 | 100 | — | — | 0.2 |
| | 25 | 100 | — | — | 1.0 |
| | 26 | 100 | — | — | 2.0 |
| | 27 | 100 | — | — | 4.0 |
| | 28 | — | 100 | — | 0.2 |
| | 29 | — | 100 | — | 3.0 |
| | 30 | — | 100 | — | 8.0 |

*PVA is an aqueous 10% solution.

TABLE 5

| | | Molded article strength | |
|---|---|---|---|
| | | Transverse rupture strength (MPa) | Rattler value (%) |
| Embodiment | 1 | 3.32 | −10 |
| | 2 | 1.88 | −16 |
| | 3 | 2.76 | −10 |
| | 4 | 2.98 | −10 |
| | 5 | 2.69 | −10 |
| | 6 | 2.07 | −13 |
| | 7 | 3.50 | −8 |
| | 8 | 2.23 | −15 |
| | 9 | 2.20 | −15 |
| | 10 | 3.54 | −8 |
| | 11 | 2.23 | −13 |
| | 12 | 2.81 | −10 |
| | 13 | 2.54 | −11 |
| | 14 | 1.72 | −18 |

TABLE 5-continued

| | | Molded article strength | |
|---|---|---|---|
| | | Transverse rupture strength (MPa) | Rattler value (%) |
| | 15 | 2.12 | −12 |
| | 16 | 1.98 | −15 |
| | 17 | 1.85 | −17 |
| Comparison | 20 | 3.10 | −9 |
| | 21 | 1.76 | −25 |
| | 22 | 1.88 | −25 |
| | 23 | 1.68 | −30 |
| | 24 | 1.51 | −34 |
| | 25 | 1.30 | −38 |
| | 26 | 1.10 | −45 |
| | 27 | 1.08 | −55 |
| | 28 | 1.59 | −30 |
| | 29 | 1.64 | −25 |
| | 30 | 1.68 | −20 |

TABLE 6

| | | Sintered compact | Magnetic properties | | | Amount of C in the sintered |
|---|---|---|---|---|---|---|
| | | density ($g/cm^3$) | Br (T) | $Hc_J$ (kA/m) | (BH)max ($kJ/m^3$) | compact (ppm) |
| Embodiment | 1 | 7.54 | 1.270 | 1492 | 310.9 | 790 |
| | 2 | 7.55 | 1.280 | 1498 | 315.8 | 680 |
| | 3 | 7.54 | 1.273 | 1502 | 311.8 | 750 |
| | 4 | 7.53 | 1.268 | 1490 | 311.3 | 810 |
| | 5 | 7.54 | 1.271 | 1498 | 311.7 | 760 |
| | 6 | 7.55 | 1.280 | 1507 | 316.7 | 650 |
| | 7 | 7.53 | 1.268 | 1489 | 311.8 | 850 |
| | 8 | 7.54 | 1.274 | 1498 | 312.5 | 680 |
| | 9 | 7.54 | 1.274 | 1495 | 313.4 | 680 |
| | 10 | 7.53 | 1.270 | 1491 | 311.5 | 700 |
| | 11 | 7.55 | 1.270 | 1504 | 311.8 | 700 |
| | 12 | 7.54 | 1.268 | 1495 | 311.0 | 830 |
| | 13 | 7.55 | 1.270 | 1500 | 311.7 | 700 |
| | 14 | 7.55 | 1.277 | 1496 | 315.0 | 710 |
| | 15 | 7.54 | 1.270 | 1501 | 311.5 | 740 |
| | 16 | 7.55 | 1.277 | 1499 | 315.6 | 690 |
| | 17 | 7.54 | 1.276 | 1493 | 313.5 | 720 |
| Comparison | 20 | 7.38 | 1.158 | 1460 | 261.7 | 930 |
| | 21 | 7.12 | ※ | ※ | ※ | 1000 |
| | 22 | 6.38 | ※ | ※ | ※ | 2200 |
| | 23 | 6.88 | ※ | ※ | ※ | 2000 |
| | 24 | 7.53 | 1.265 | 1500.8 | 311.3 | 650 |
| | 25 | 7.12 | ※ | ※ | ※ | 1300 |
| | 26 | 6.75 | ※ | ※ | ※ | 2000 |
| | 27 | 5.12 | ※ | ※ | ※ | 2800 |
| | 28 | 7.40 | 1.245 | 1501.7 | 302.5 | 1100 |
| | 29 | 6.80 | ※ | ※ | ※ | 2200 |
| | 30 | 4.90 | ※ | ※ | ※ | 3100 |

※Could no be determined
Magnet composition = 13.4 at % Nd-2.6 at % Dy-77.8 at % Fe-6.2 at % B

TABLE 7

| | Depolymerized polymer | |
|---|---|---|
| | Average molecular weight | Dynamic viscosity ($mm^2/sec$) |
| Embodiment | | |
| 1 | 350 | 30 |
| 3 | 350 | 30 |
| 9 | 450 | 130 |

TABLE 7-continued

| | Depolymerized polymer | |
|---|---|---|
| | Average molecular weight | Dynamic viscosity ($mm^2/sec$) |
| 11 | 700 | 3000 |
| 13 | 700 | 3000 |
| 15 | 700 | 3000 |
| 16 | 550 | 700 |
| Comparison | | |
| 25 | — | — |
| 29 | — | — |

TABLE 8

| | Lubricant component (wt %) | | | Amount of |
|---|---|---|---|---|
| | Depolymerized polymer | Low-viscosity mineral oil | Hydro carbon solvent | lubricant added (wt %) |
| Embodiment | | | | |
| 1 | 100 | | 0 | 3.0 |
| 3 | 50 | | 50 | 3.0 |
| 9 | 100 | | 0 | 0.1 |
| 11 | 70 | 20 | 10 | 0.5 |
| 13 | 30 | 30 | 40 | 2.0 |
| 15 | 10 | 50 | 40 | 5.0 |
| 16 | 10 | 50 | 40 | 1.0 |
| Comparison | | | | |
| | Oleic acid ester lubricant | PVA (polyvinyl alcohol) | | |
| 25 | 100 | — | — | 0.2 |
| 29 | — | 100 | — | 0.2 |

*PVA is an aqueous 10% solution.

TABLE 9

| | Moldability evaluation | |
|---|---|---|
| | Green density ($g/cm^3$) | Number of articles with molding defects (out of 10,000 articles) |
| Embodiment | | |
| 1 | 4.4 | 68 |
| | 4.2 | 54 |
| 2 | 4.4 | 72 |
| | 4.2 | 73 |
| 6 | 4.4 | 98 |
| | 4.2 | 82 |
| 8 | 4.4 | 102 |
| | 4.2 | 84 |
| 10 | 4.4 | 90 |
| | 4.2 | 76 |
| 12 | 4.2 | 103 |
| | 4.2 | 81 |
| 13 | 4.2 | 112 |
| | 4.2 | 95 |
| Comparison | | |
| 4 | 4.4 | 912 |
| | 4.2 | 448 |
| 8 | 4.4 | 310 |
| | 4.2 | 169 |

Embodiment 3

Electrolytic iron with a purity of 99.9%, ferroboron alloy containing 19.8 wt % B, and Nd and Dy with a purity of 99.7% or higher were used as the starting alloy. These were mixed and melted under high frequency and then cast into a mold with a water-cooling casting mold to obtain ingots with a composition of 13.4 at % Nd-2.6 at % Dy-77.8 at % Fe-6.2 at % B.

Next, the above-mentioned ingots were crushed with a stamp mill and then further comminution treatment was performed by hydrogen occlusion, etc., to obtain crushed powder with an average particle diameter of 40 $\mu$m. The crushed powder that was obtained was pulverized with a jet mill using $N_2$ gas as the inert gas under conditions of a gas pressure of 6 kg/mm$^2$ to obtain fine powder with an average particle diameter of 3 $\mu$m.

Mixtures of various lubricants 1,2 were added to and mixed with the R—Fe—B fine crushed powder that was obtained as shown in Table 10. Methyl caproate and methyl caprylate or Ti coupling agent (boiling point: 200° C. or higher, effective component: 97.0% or higher, Ajinomoto Co., Ltd., Purenakuto KR-TTS) were used for the lubricant, and a copolymer of isobutylene and normal butylene (molecular weight shown in Table 1) was used as the depolymerized polymer, naphthene purified mineral oil with a dynamic viscosity of 5 mm$^2$/second at 40° C. was used as the low-viscosity mineral oil, and normal paraffin solvent (8 to 15 carbons), isoparaffin solvent (8 to 15 carbons) and naphthene solvent (6 to 15 carbons) with a boiling point of 80° C. to 250° C. were used as the hydrocarbon solvent.

Nert, the abovementioned fine powder was introduced to the mold, oriented in a magnetic field of 10 kOe, and molded under a pressure of 1.5 T/cm$^2$ perpendicular to the magnetic field to obtain a molded article with dimensions 20 mm×15 mm×10 mm. Strength of the molded article that was obtained is shown in Table 11 and the evaluation of moldability is shown in Table 13. The molded article strength was determined by rattler tests and the method of determining transverse rupture strength.

Moreover, the molded article that was obtained was sintered in an Ar ambient atmosphere for 4 hours at 1,070° C. and further aged for 1 hour at 580° C. in an Ar ambient atmosphere. The magnetic properties of the test piece that was obtained are shown in Table 12.

Comparison 3

Ester lubricant (boiling point: 87° C., effective component: 25 wt % methyl oleate ester, 75 wt % cyclohexane, Paresu Kagaku Co., Ltd., Magurupu PS-A-1) was added as shown in Table 10 at 0.2 to 4.0 wt % to crushed powder that had been obtained with the same composition and under the same conditions as in Embodiment 3 and then caution with a jet mill was performed to obtain fine powder with an average particle diameter of 3 $\mu$m. Next, molding in a magnetic field, sintering and aging were performed under the same conditions as in Embodiment 1. Strength of the molded article that was obtained is shown in Table 2, magnetic properties of the test piece are shown in Table 12, and the evaluation of moldability is shown in Table 13.

Comparison 4

Ester lubricant (boiling point: 150° C., effective component: 10 wt %, Paresu Kagaku Co., Ltd., Magurupu PS-A-21) and or Ti coupling agent (boiling point: 200° C. or higher, effective component: 97.0% or more, Ajinomoto Co., Ltd., Purenakuto KR-TTS) were added and mixed as shown in Table 1 with fine powder obtained with the same composition and under the same conditions as in Embodiment 3 and then the above-mentioned fine powder was introduced to a mold and molded in a magnetic field, sintered and aged under the same conditions as in Embodiment 1. Strength of the molded article that was obtained is shown in Table 12, magnetic properties of the test piece are shown in Table 12, and the evaluation of moldability is shown in Table 13.

Comparison 5

A copolymer of isobutylene and normal-butylene with a molecular weight of 550 as the depolymerized polymer, naphthene purified mineral oil with a dynamic viscosity of 5 mm$^2$/second at 40° C. as the low-viscosity mineral oil, and further, a mixture of normal paraffin solvent (8 to 15 carbons), isoparaffin solvent (8 to 15 carbons) and naphthene solvent (6 to 15 carbons) with a boiling point of 80° C. to 250° C. as the hydrocarbon solvent were added and mixed as shown in Table 10 with a fine powder obtained with the same composition and under the same conditions as in Embodiment 3.

Then the above-mentioned fine powder was introduced to a mold and molded in a magnetic field, sintered and aged under the same conditions in Embodiment 3. Strength of the molded article that was obtained is shown in Table 11, the magnetic properties of the test piece are shown in Table 12, and the evaluation of moldability is shown In Table 13.

TABLE 10

| | Amount of lubricant 1 added (wt %) | | | Lubricant 2 components | | | | Amount of lubricant added (wt %) |
|---|---|---|---|---|---|---|---|---|
| | | | | Depolymerized polymer | | Low-viscosity mineral oil | hydro-carbon solvent | |
| | Methyl caproate | Methyl caprylate | Ti coupling agent | | Molecular weight | | | |
| Embodiment | | | | | | | | |
| 1 | 0.06 | | | 100 | 350 | | | 2.0 |
| 2 | | 0.09 | | 100 | 350 | | | 3.0 |
| 3 | 0.048 | | | 60 | 350 | | 40 | 6.0 |
| 4 | | 0.215 | | 50 | 350 | | 50 | 5.0 |
| 5 | 0.015 | | 0.01 | 100 | 450 | | | 0.5 |
| 6 | | 0.01 | 0.01 | 100 | 450 | | | 1.0 |
| 7 | 0.07 | | 0.01 | 60 | 450 | | 40 | 2.0 |
| 8 | | 0.012 | 0.01 | 52 | 450 | | 48 | 1.0 |
| 9 | 0.18 | | | 40 | 600 | 20 | 40 | 6.0 |

TABLE 10-continued

| | | | | | | | | |
|---|---|---|---|---|---|---|---|---|
| 10 | | 0.24 | | 40 | 600 | 20 | 40 | 8.0 |
| 11 | 0.08 | | 0.01 | 40 | 700 | 20 | 40 | 2.0 |
| 12 | 0.12 | 0.12 | 0.04 | 40 | 700 | 20 | 40 | 8.0 |

| | Methyl caproate lubricant | Ti coupling agent | Oleic acid ester lubricant | |
|---|---|---|---|---|
| Comparison | | | | |
| 1 | | | 100 | 0.2 |
| 2 | | | 100 | 4.0 |
| 3 | 100 | | | 0.3 |
| 4 | 99.7 | 0.3 | | 0.3 |
| 5 | | | | |

TABLE 11

| | Molded article strength | |
|---|---|---|
| | Transverse rupture strength (MPa) | Rattler value (%) |
| Embodiment | | |
| 1 | 1.98 | −16 |
| 2 | 2.00 | −14 |
| 3 | 2.20 | −13 |
| 4 | 2.10 | −14 |
| 5 | 1.75 | −22 |
| 6 | 1.80 | −20 |
| 7 | 1.85 | −17 |
| 8 | 1.78 | −23 |
| 9 | 2.22 | −13 |
| 10 | 2.30 | −12 |
| 11 | 1.98 | −16 |
| 12 | 2.40 | −11 |
| Comparison | | |
| 1 | 1.51 | −34 |
| 2 | 1.08 | −55 |
| 3 | 1.68 | −30 |
| 4 | 1.60 | −32 |
| 5 | | |

TABLE 12

| | Sintered compact | Magnetic properties | | | Amount of C in |
|---|---|---|---|---|---|
| | density (g/cm$^3$) | Br (T) | Hcj (kA/m) | (BH)max (kJ/m$^3$) | sintered compact (ppm) |
| Embodiment | | | | | |
| 1 | 7.54 | 1.284 | 1495 | 323.9 | 750 |
| 2 | 7.53 | 1.284 | 1498 | 323.9 | 690 |
| 3 | 7.55 | 1.280 | 1498 | 321.9 | 700 |
| 4 | 7.54 | 1.282 | 1496 | 322.9 | 710 |
| 5 | 7.53 | 1.288 | 1491 | 326.0 | 600 |
| 6 | 7.53 | 1.286 | 1492 | 325.0 | 620 |
| 7 | 7.54 | 1.288 | 1495 | 326.0 | 660 |
| 8 | 7.54 | 1.285 | 1490 | 324.5 | 620 |
| 9 | 7.53 | 1.280 | 1493 | 321.9 | 760 |
| 10 | 7.53 | 1.279 | 1491 | 321.4 | 820 |
| 11 | 7.52 | 1.288 | 1499 | 326.0 | 750 |
| 12 | 7.54 | 1.279 | 1498 | 321.4 | 850 |
| Comparison | | | | | |
| 1 | 7.38 | 1.265 | 1500 | 311.4 | 650 |
| 2 | 5.12 | ※ | ※ | ※ | 2800 |
| 3 | 7.54 | 1.283 | 1496 | 323.4 | 700 |

TABLE 12-continued

| | Sintered compact | Magnetic properties | | | Amount of C in |
|---|---|---|---|---|---|
| | density (g/cm$^3$) | Br (T) | Hcj (kA/m) | (BH)max (kJ/m$^3$) | sintered compact (ppm) |
| 4 | 7.54 | 1.285 | 1492 | 324.5 | 700 |
| 5 | | | | | |

*Could not be determined

Magnet composition = 13.4 at % Nd-2.6 at % Dy-77.8 at % Fe-6.2 at % B

TABLE 13

| | Evaluation of moldability | |
|---|---|---|
| | Green density (g/cm$^3$) | Number of articles with molding defects (out of 10,000) |
| Embodiment | | |
| 1 | 4.4 | 161 |
| | 4.2 | 146 |
| 3 | 4.4 | 113 |
| | 4.2 | 71 |
| 5 | 4.4 | 172 |
| | 4.2 | 152 |
| 7 | 4.4 | 140 |
| | 4.2 | 92 |
| 9 | 4.4 | 112 |
| | 4.2 | 81 |
| 12 | 4.2 | 105 |
| | 4.2 | 77 |
| Comparison | | |
| 1 | 4.4 | 439 |
| | 4.2 | 180 |
| 4 | 4.4 | 350 |
| | 4.2 | 211 |

Embodiment 4

Using starting powder for R—Fe—B magnets with a composition of 14.5 wt % Nd, 0.5 wt % B, 78 wt % Fe, and 7 wt % Co and a particle diameter of 4 $\mu$m, a mold release with the composition shown in Tables 14 and 15 was applied to the inside surface of the mold dies and molding was performed under a molding pressure of 1.0 T/mm$^2$ to make a molded article with dimensions 10 mm×15 mm×20 mm. The ejection pressure, amount of spring back, and molded article transverse rupture strength in this case are shown in Table 16.

The maximum load when the molded article was ejected from the mold after pressing served as ejection pressure. The amount of movement of the punch immediately after the molding load was brought to 0 with the punch stop position during maximum pressurization as the criterion served as the amount of spring back.

After sintering the molded article that was obtained for 3 hours at 1,060° C., it was aged by being kept for 2 hours at 530° C. to obtain a sintered magnet. Magnetic properties of this R—Fe—B sintered magnet are shown in Table 17.

TABLE 14

| | Main component | | | |
|---|---|---|---|---|
| | Methyl caproate Number of carbons 7(6) Purity 98 | Methyl caprylate Number of carbons 9(8) Purity 98 | Methyl laurate Number of carbons 13(12) Purity 95 | Methyl oleate Number of carbons 19(18) Purity 99 |
| Embodiment | | | | |
| 1 | 10.00 | — | — | — |
| 2 | — | 5.00 | — | — |
| 3 | 10.00 | — | — | — |
| 4 | — | 10.00 | — | — |
| 5 | 2.00 | 4.00 | — | — |
| Comparison | | | | |
| 6 | 50.00 | — | — | — |
| 7 | — | 5.00 | — | — |
| 8 | 10.00 | — | — | — |
| 9 | — | 40.00 | — | — |
| 10 | — | — | 10.00 | — |
| 11 | — | — | — | 10.00 |

TABLE 15

| | Admixture | | Solvent | |
|---|---|---|---|---|
| | Arachidic acid Number of carbons20 Purity98 | Behenic acid Number of carbons22 Purity98 | Normal paraffin | Isoparaffin |
| Embodiment | | | | |
| 1 | 0.010 | — | 98.990 | — |
| 2 | 0.100 | — | 94.900 | — |
| 3 | — | 0.020 | — | 89.980 |
| 4 | — | 0.100 | — | 89.900 |
| 5 | 0.010 | 0.010 | 93.980 | — |
| Comparison | | | | |
| 6 | 0.010 | — | 49.990 | — |
| 7 | 0.700 | — | 94.300 | — |
| 8 | — | 0.002 | — | 39.998 |
| 9 | — | 0.100 | — | 59.900 |
| 10 | — | — | — | 90.000 |
| 11 | — | — | — | 90.000 |

TABLE 16

| | Molding pressure T/cm$^2$ | Ejection pressure kg | Amount of spring back mm | Molded article transverse rupture strength MPa |
|---|---|---|---|---|
| Embodiment | | | | |
| 1 | 1.0 | 71 | 0.71 | 1.37 |
| 2 | 1.0 | 69 | 0.69 | 1.41 |

TABLE 16-continued

| | Molding pressure T/cm$^2$ | Ejection pressure kg | Amount of spring back mm | Molded article transverse rupture strength MPa |
|---|---|---|---|---|
| 3 | 1.0 | 70 | 0.70 | 1.37 |
| 4 | 1.0 | 65 | 0.68 | 1.38 |
| 5 | 1.0 | 73 | 0.71 | 1.40 |
| Comparison | | | | |
| 6 | 1.0 | 73 | 0.71 | 1.01 |
| 7 | 1.0 | 63 | 0.70 | 0.98 |
| 8 | 1.0 | 89 | 0.99 | 1.38 |
| 9 | 1.0 | 68 | 0.73 | 0.98 |
| 10 | 1.0 | 92 | 1.09 | 1.41 |
| 11 | 1.0 | 105 | 1.28 | 1.51 |

TABLE 17

| | Magnetic properties | | | Number of articles |
|---|---|---|---|---|
| | Br(T) | iHc(kA/m) | (BH)max (kJ/m$^3$) | molded continuously (articles) |
| Embodiment | | | | |
| 1 | 1.341 | 955.2 | 343.8 | >1000 |
| 2 | 1.330 | 956.0 | 341.5 | >1000 |
| 3 | 1.333 | 956.0 | 342.9 | >1000 |
| 4 | 1.334 | 955.3 | 342.5 | >1000 |
| 5 | 1.330 | 955.5 | 342.3 | >1000 |
| Comparison | | | | |
| 6 | 1.327 | 955.0 | 340.6 | >1000 |
| 7 | 1.330 | 957.0 | 341.5 | >1000 |
| 8 | 1.315 | 955.3 | 330.9 | 300 |
| 9 | 1.327 | 955.6 | 340.1 | >1000 |
| 10 | 1.310 | 955.7 | 330.2 | 50 |
| 11 | 1.300 | 955.9 | 325.3 | 20 |

INDUSTRIAL APPLICABILITY

By means of the method of producing an R—Fe—B magnet of the present invention, a lubricant for molding comprising specific amounts of at least one of methyl caproate lubricant and methyl caprylate lubricant and/or depolymerized polymer, or further, a specific amount of Ti coupling agent, are added and mixed with a pulverized powder that is the starting material for R—Fe—B magnets obtained by various conventional methods, such as ingot comminution, strip casting, or Ca reduction, etc., to uniformly coat the surface of the fine powder with the above-mentioned lubricant and then the powder is molded in a magnetic field and as a result, each particle of the fine powder has high crystal orientation in the direction of the magnetic field, high Br is obtained, and mold strength is markedly improved, providing excellent mass-productivity and improving yield.

The mold release for molding R—Fe—B sintered magnets of the present invention is a mold release consisting of a specific amount of saturated fatty acid with 20 to 24 carbons, which has excellent lubricating performance, mixed with the main component of volatile methyl caproate or methyl caprylate, which inhibit an increase in the amount of carbon in the sintered compact after sintering, with the remainder being volatile solvent, and therefore, it is possible to inhibit the increase in ejection pressure that accompanies press pressurization. This effect is more obvious with molded articles of high density. Moreover, the amount of spring back can also be reduced by approximately 3% when compared to the case of molding with a conventional mold release that uses methyl laurate. The composition range within which molding with fewer defects, such as cracks, etc., is possible can be enlarged because of this reduction in ejection pressure, reduction in the amount of spring back, and improvement in green strength.

What is claimed is:

1. A method of producing an R—Fe—B permanent magnet, comprising the steps of:

adding and mixing 0.01 to 5.0 wt % of at least one of methyl caproate lubricant and methyl caprylate lubricant with R—FE—B alloy powder and then molding in a magnetic field and sintering.

2. A method of producing an R—Fe—B permanent magnet, comprising the steps of:

adding and mixing 0.01 to 5.0 wt % of at least one of methyl caproate lubricant and methyl caprylate lubricant and 0.01 to 0.5 wt % Ti coupling agent with R—Fe—B alloy powder and then molding in a magnetic field and sintering.

3. A method of producing an F—Fe—B permanent magnet, comprising the steps of: adding and mixing 0.01 wt % to 10.0 wt % lubricant for molding comprising depolymerized polymer to R—Fe—B alloy powder and then molding in a magnetic field and sintering, said depolymerized polymer being selected from the group consisting of a copolymer of isobutylene and normal butylenes, an isobutylene polymer, an alkyl methacrylate polymer or copolymer, and an alkylene glycol polymer or copolymer.

4. The method of producing an R—Fe—B permanent magnet according to claim 3, wherein the lubricant for molding consists of said depolymerized polymer.

5. The method of producing an R—Fe—B permanent magnet according to claim 4, wherein the average molecular weight of the depolymerized polymer is 450 or less.

6. The method of producing an R—Fe—B permanent magnet according to claim 3, wherein the lubricant for molding consists of 0.7. wt % to 99.9 wt % said depolymerized polymer and a hydrocarbon solvent with a boiling point of 80° C. to 250° C. as a remainder.

7. The method of producing an R—Fe—B permanent magnet according to claim 3, wherein the lubricant for molding consists of 0.1 wt % to 70.0 wt % said depolymerized polymer, 5.0 wt % to 70.0 wt % low viscosity mineral oil with a dynamic viscosity (40° C.) of 3 to 30 $mm^2$/second, and hydrocarbon solvent with a boiling point of 80° C. to 250° C. as a remainder.

8. A method of producing an R—Fe—B magnet, comprising the steps of: adding and mixing 0.01 to 5.0 wt % of at least one of methyl caproate and methyl caprylate and 0.01 wt % to 10.0 wt % lubricant for molding comprising depolymerized polymer to R—Fe—B alloy powder and then molding in a magnetic field and sintering, said depolymerized polymer being selected from the group consisting of a copolymer of isobutylene and normal butylenes, an isobutylene polymer, an alkyl methacrylate polymer or copolymer, and an alkylene glycol polymer or copolymer.

9. A method of producing an R—Fe—B magnet, comprising the steps of: adding and mixing 0.01 to 6.0 wt % of at least one of methyl caproate and methyl caprylate, 0.01 wt % to 0.5 wt % Ti coupling agent, and 0.01 wt % to 10.0 wt % lubricant for molding comprising depolymerized polymer to R—Fe—B alloy powder and then molding in a magnetic field and sintering, said depolymerized polymer being selected from the group consisting of a copolymer of isobutylene and normal butylenes, an isobutylene polymer, an alkyl methacrylate polymer or copolymer, and an alkylene glycol polymer or copolymer.

10. The method of producing an R—Fe—B magnet according to claim 8 or claim 9, wherein the total amount of lubricant for molding comprising depolymerized polymer consists of said depolymerized polymer.

11. The method of producing an R—Fe—B magnet according to claim 8 or claim 9, wherein the lubricant for molding comprising depolymerized polymer consists of 0.1 wt % to 99.9 wt % said depolymerized polymer and hydrocarbon solvent with a boiling point of 80° C. to 250° C. as a remainder.

12. The method of producing an R—Fe—B magnet according to claim 8 or claim 9, wherein the lubricant for molding comprising depolymerized polymer consists of 5.0 wt % to 70 wt % low-viscosity mineral oil with a boiling point of 200° C. to 500° C. and a dynamic viscosity (40° C.) of 3 to 30 $mm^2$/second and hydrocarbon solvent with a boiling point of 80°to 250° C. as a remainder.

13. A lubricant for molding R—Fe—B permanent magnets, consisting of 0.2 to 50 wt % methyl caproate and 1 or 2 or more hydrocarbon solvents as a remainder.

14. The lubricant for molding R—Fe—B permanent magnets according to claim 13, wherein the solvent consists of isoparaffin with a boiling point of 120 to 180° C.

15. A lubricant for molding R—Fe—B permanent magnets, consisting of depolymerized polymer selected from the group consisting of a copolymer of isobutylene and normal butylenes, an isobutylene polymer, an alkyl methacrylate polymer or copolymer, and an alkylene glycol polymer or copolymer.

16. The lubricant for molding R—Fe—B permanent magnets according to claim 15, wherein average molecular weight of the depolymerized polymer is 450 or less.

17. A lubricant for molding R—Fe—B permanent magnets, consisting of 0.1 wt % to 99 wt % depolymerized polymer and hydrocarbon solvent with a boiling point of 80° C. to 250° C. as a remainder, said depolymerized polymer being selected from the group consisting of a copolymer of isobutylene and normal butylenes, an isobutylene polymer, an alkyl methacrylate polymer or copolymer, and an alkylene glycol polymer or copolymer.

18. A lubricant for molding R—Fe—B permanent magnets, consisting of 0.1 wt % to 70 wt % depolymerized polymer, 5.0 wt to 70 wt % low-viscosity mineral oil with a boiling point of 200° C. to 500° C. and a dynamic viscosity (40° C.) of 3 to 30 $mm^2$/second, and hydrocarbon solvent with a boiling point of 80° C. to 250° C. as a remainder, said depolymerized polymer being selected from the group consisting of a copolymer of isobutylene and normal butylenes, an isobutylene polymer, an alkyl methacrylate polymer or copolymer, and an alkylene glycol polymer or copolymer.

19. A lubricant for molding R—Fe—B magnets, consisting of 0.01 to 5.0 wt % of at least one selected from methyl caproate and methyl caprylate and lubricant comprising depolymerized polymer as a remainder, said depolymerized polymer being selected from the group consisting of a copolymer of isobutylene and normal butylenes, an isobutylene polymer, an alkyl methacrylate polymer or copolymer, and an alkylene glycol polymer or copolymer.

20. A lubricant for molding R—Fe—B permanent magnets, consisting of 0.01 to 5.0 wt % of at least one of methyl caproate and methyl caprylate, 0.01 wt % to 0.5 wt % Ti coupling agent, and lubricant comprising depolymerized polymer as a remainder, said depolymerized polymer being selected from the group consisting of a copolymer of isobutylene and normal butylenes, an isobutylene polymer, an alkyl methacrylate polymer or copolymer, and an alkylene glycol polymer or copolymer.

21. The lubricant for molding R—Fe—B magnets according to claim 19 or claim 20, wherein the total amount of lubricant comprising depolymerized polymer consists of said depolymerized polymer.

22. The lubricant for molding R—Fe—B magnets according to claim 19 or claim 20, wherein the lubricant comprising said depolymerized polymer consists of 0.1 wt % to 99.9 wt % said depolymerized polymer and hydrocarbon solvent with a boiling point of 80° C. to 250° C. as a remainder.

23. The lubricant for molding R—Fe—B magnets according to claim 19 or claim 20, wherein the lubricant comprising depolymerized polymer consists of 0.1 wt % to 70 wt % said depolymerized polymer, 5.0 wt % to 70 wt % low-viscosity mineral oil with a boiling point of 200° C. to 500° C. and dynamic viscosity (40° C.) of 3 to 30 $mm^2$/second and hydrocarbon solvent with a boiling point of 80° C. to 250° C. as a remainder.

24. A mold release for molding R—Fe—B magnets, consisting of 2 to 20 wt % of at least 1 or 2 of methyl caproate and methyl caprylate as the lubricant component and 0.005 to 0.5 wt % of 1 or 2 or more saturated fatty acids with 20 to 24 carbons as a admixture, the remainder being hydrocarbon with a boiling point of 80 to 200° C.

* * * * *